US009275569B2

(12) United States Patent
Wu et al.

(10) Patent No.: US 9,275,569 B2
(45) Date of Patent: Mar. 1, 2016

(54) FLAT PANEL DISPLAY, THRESHOLD VOLTAGE SENSING CIRCUIT, AND METHOD FOR SENSING THRESHOLD VOLTAGE

(71) Applicant: E Ink Holdings Inc., Hsinchu (TW)

(72) Inventors: Chi-Liang Wu, Hsinchu (TW); Po-Hsin Lin, Hsinchu (TW); Young-Ran Chuang, Hsinchu (TW); Chin-Wen Lin, Hsinchu (TW); Ted-Hong Shinn, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 191 days.

(21) Appl. No.: 13/924,639

(22) Filed: Jun. 24, 2013

(65) Prior Publication Data

US 2014/0085172 A1 Mar. 27, 2014

(30) Foreign Application Priority Data

Sep. 27, 2012 (TW) ..... 101135532 A

(51) Int. Cl.
*G09G 3/36* (2006.01)
*G09G 3/20* (2006.01)

(52) U.S. Cl.
CPC ..... *G09G 3/2092* (2013.01); *G09G 3/20* (2013.01); *G09G 2300/08* (2013.01); *G09G 2310/0267* (2013.01)

(58) Field of Classification Search
CPC ..... G09G 2300/043; G09G 2320/04; G09G 3/20; G09G 2300/08; G09G 2310/0267; G09G 3/2092
USPC ..... 345/92
See application file for complete search history.

(56) References Cited

U.S. PATENT DOCUMENTS

| | | | | |
|---|---|---|---|---|
| 2003/0057420 | A1 | 3/2003 | Cok | |
| 2007/0052646 | A1 * | 3/2007 | Ishiguchi | 345/92 |
| 2008/0088559 | A1 | 4/2008 | Lai et al. | |
| 2009/0128527 | A1 * | 5/2009 | Itakura et al. | 345/205 |

FOREIGN PATENT DOCUMENTS

| | | | |
|---|---|---|---|
| CN | 1314671 | A | 9/2001 |
| CN | 101452688 | A | 6/2009 |

(Continued)

OTHER PUBLICATIONS

TW Office Action that these art references were cited.

(Continued)

*Primary Examiner* — Jonathan Boyd
(74) *Attorney, Agent, or Firm* — CKC & Partners Co., Ltd.

(57) ABSTRACT

A threshold voltage sensing circuit applied in a display panel includes a first sensor and a second sensor. The first sensor positioned in the display panel receives an operation signal at a regular time point after start-up and continuously receives multiple driving signals which are the same as those received by the pixel circuits of the display panel and outputs a first output voltage accordingly. The second sensor positioned in the display panel receives the driving signals at a regular time point after start-up and outputs a second output voltage accordingly. When the voltage difference between the first output voltage and the second output voltage is beyond a variation standard, the low level of the gate voltage of the pixel circuit is adjusted.

14 Claims, 4 Drawing Sheets

(56) References Cited

FOREIGN PATENT DOCUMENTS

| | | | |
|---|---|---|---|
| JP | 2002221930 | A | 8/2002 |
| KR | 20010091078 | A | 10/2001 |
| TW | 200614852 | A | 5/2006 |
| TW | 200710816 | A | 3/2007 |
| TW | 200813968 | A | 3/2008 |
| TW | 200818091 | A | 4/2008 |
| TW | 200923481 | A | 6/2009 |
| TW | 201126498 | A1 | 8/2011 |

OTHER PUBLICATIONS

Corresponding Chinese office action that these art references were cited on Aug. 5, 2015.

* cited by examiner

FLAT PANEL DISPLAY, THRESHOLD VOLTAGE SENSING CIRCUIT, AND METHOD FOR SENSING THRESHOLD VOLTAGE

RELATED APPLICATIONS

This application claims priority to Taiwanese Application Serial Number 101135532, filed Sep. 27, 2012, which is herein incorporated by reference.

BACKGROUND

1. Field of Invention

The invention relates to a flat panel display. More particularly, the invention relates to a panel design of a flat panel display.

2. Description of Related Art

With the development of science, technology and the growth of human civilization, various electronic devices are pursuing features of high speed, high performance and light weight, and accordingly various portable electronic devices become the main stream, such as notebooks, cell phones, e-dictionaries, personal digital assistant (PDA), web pad, tablet PC and the like. For an image display of a portable electronic device, in order to meet the miniaturization trend of the products, currently a flat panel display with excellent characteristics such as a good space utilization, high picture quality, low power consumption and little radiation have been widely used.

Generally, the flat panel display consists of a display panel and multiple driver ICs, wherein the display panel generally consists of pixels arranged in a row/column array form. Each pixel mainly includes a thin film transistor (TFT) and an electrode jointly formed on a substrate. The gates of the thin film transistors in the same row are connected together through a scanning line and then controlled by a gate driver. The sources of the thin film transistors in the same column are connected together through a data line and then controlled by a source driver. A common electrode (Vcom) is formed on another substrate.

However, after a traditional display panel is operated at a high temperature or has been driven for a long period of time, a threshold voltage thereof will be shifted due to a stress effect, and thus it is difficult to close the thin film transistor and the display panel is too white, which further causes a Mura phenomenon, not only influencing the quality of an image shown by the display, but also shortening the lifetime of a panel product.

SUMMARY

According to an embodiment of the invention, the threshold voltage sensing circuit applied in a display panel includes a first sensor and a second sensor. The first sensor positioned in the display panel receives an operation signal at a regular time point after start-up and continuously receives a plurality of driving signals which are the same as those received by the pixel circuits of the display panel and outputs a first output voltage accordingly. The second sensor positioned in the display panel receives the driving signals at a regular time point after start-up and outputs a second output voltage accordingly. When the voltage difference between the first output voltage and the second output voltage is beyond a variation standard, the logy level of the gate voltage of the pixel circuit is adjusted.

According to an embodiment of the invention, the flat panel display is used for displaying images. This flat panel display includes a display panel and a gate driving circuit. The display panel includes a plurality of pixel circuits. Each of the pixel circuits includes a pixel thin film transistor. The pixel thin film transistor receives a plurality of driving signals. The display panel further includes a threshold voltage sensing circuit. The threshold voltage sensing circuit has a first sensor and a second sensor. The first sensor positioned in the display panel receives an operation signal at a regular time point after start-up and continuously receives a plurality of driving signals which are the same as those received by the pixel circuits of the display panel and outputs a first output voltage accordingly. The second sensor positioned in the display panel receives the driving signals at a regular time point after start-up and outputs a second output voltage accordingly.

The gate driving circuit is used for driving the display panel. This gate driving circuit includes a comparator for comparing the first output voltage and the second output voltage. When the voltage difference between the first output voltage and the second output voltage is beyond a variation standard, the comparator outputs a control signal to reduce the low level of the gate voltage of the pixel circuit.

According to an embodiment of the invention, a method for sensing a threshold voltage applied in a display panel includes driving a first sensor positioned in the display panel through an operation signal at a regular time point after start-up, and continuously driving the first sensor through a plurality of driving signals which are the same as those received by the pixel circuits of the display panel, so as to enable the first sensor to output a first output voltage; driving a second sensor positioned in the display panel through the above-mentioned driving signals at a regular time point after start-up, so as to enable the second sensor to output a second output voltage; subsequently comparing the first output voltage and the second output voltage; and adjusting the low level of the gate voltage of the pixel circuit when the voltage difference between the first output voltage and the second output voltage is beyond a variation standard.

The threshold voltage sensing circuit, the method for sensing the threshold voltage, and the flat panel display of the above-mentioned embodiments can detect the state of the thin film transistor in the display panel to determine whether the threshold voltage of the thin film transistor is shifted, timely adjust the low level of the gate voltage, reduce the Mura phenomenon and increase the lifetime of the display panel.

BRIEF DESCRIPTION OF THE DRAWINGS

In order to make the foregoing as well as other aspects, features, advantages, and embodiments of the invention more apparent, the accompanying drawings are described as follows.

DETAILED DESCRIPTION

With respect to the threshold voltage sensing circuit, the method for sensing threshold voltage, and a flat panel display of the following embodiments, two sensors are positioned in a display panel. When the display panel is started up, the sensors detect whether a threshold voltage of a thin film transistor in the display panel shifts. If a threshold voltage shift is detected, a signal is fed back to a gate driving circuit, so as to adjust the low level of a gate driving voltage, reduce a Mura phenomenon and increase the lifetime of a product, thereby widening the application range.

Figure 1:
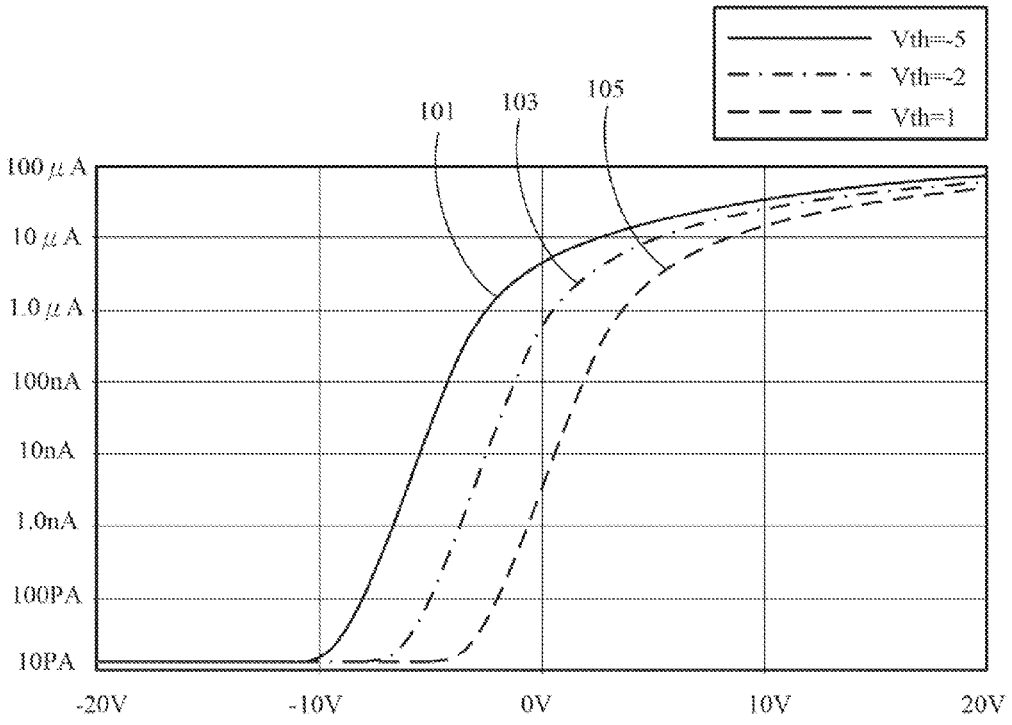
FIG. 1 illustrates a schematic view of a current-voltage characteristic curve of a thin film transistor according to an embodiment of the invention.

Referring to FIG. 1, it illustrates a schematic view of a current-voltage characteristic curve of a thin film transistor according to an embodiment of the invention. A drain and a gate of a thin film transistor which is used for sensing continuously receive driving signals. The drain receives a DC voltage of a constant value, and the gate receives an input voltage, so that the thin film transistor is formed as an inverter. The current-voltage characteristic curve of the thin film transistor is shown in FIG. 1, in which a curve 105 is an original characteristic curve of the thin film transistor, of which the threshold voltage (Vth) is maintained as 1 V; a curve 103 is a characteristic curve of the thin film transistor when the Vth is shifted to −2 V; and a curve 101 is a characteristic curve of the thin film transistor when the Vth is shifted to −5 V after the thin film transistor is operated at a high temperature or has been driven for a long period of time.

It can be seen from FIG. 1 that when the thin film transistor is subjected to a stress effect, the Vth thereof is shifted towards a negative value, and thus when a voltage of 0 V (transverse axis) is inputted to the thin film transistor, the current outputted therefrom is increased, and the characteristic curve is moved upwards. That is, the threshold voltage shift state can be obtained by observing the current value corresponding to the voltage of 0 V indicated by the characteristic curve.

Therefore, it can be known that after the display panel is operated at a high temperature or has been driven for a long period of time, since the thin film transistor is subjected to the stress effect, the Vth thereof is shifted towards a negative value. Compared to the original state, it becomes difficult to turn off the thin film transistor, and a Mura phenomenon is caused, which reduces the lifetime of the display panel product. If the low level of the gate driving voltage (VGL) is reduced, for example, reduced gradually from −20 V to −23 V, then the Mura phenomenon can be gradually reduced and becomes not obvious since the thin film transistor positioned in the display panel is gradually turned off.

Figure 2A:
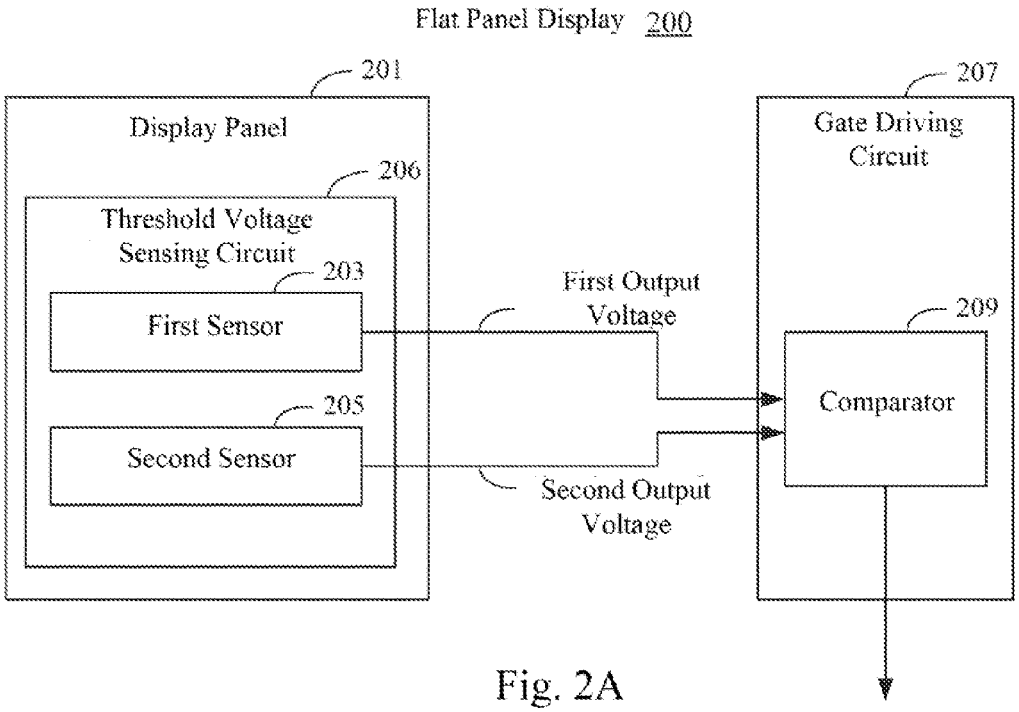
FIG. 2A illustrates a block diagram of a flat panel display according to an embodiment of the invention.
Figure 2B:
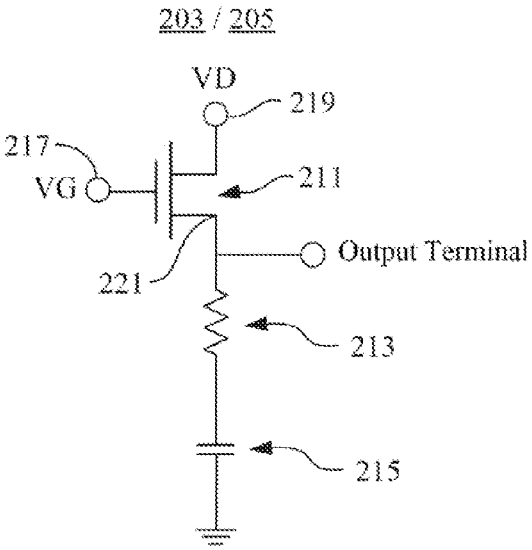
FIG. 2B illustrates a circuit diagram of a first sensor and a second sensor according to an embodiment of the invention.

FIGS. 2A and 2B respectively illustrate a block diagram of a flat panel display and a circuit diagram of a first sensor as well as a second sensor according to an embodiment of the invention. A flat panel display 200 includes a display panel 201 and a gate driving circuit 207. A threshold voltage sensing circuit 206 applied to the display panel 201 includes a first sensor 203 and a second sensor 205. The first sensor 203 and the second sensor 205 are both positioned in the display panel 201, and the first sensor 203 and the second sensor 205 may be positioned outside a display area of the display panel 201 to avoid affecting the display quality.

The first sensor 203 positioned in the display panel 201 receives an operation signal at a regular time point after start-up and continuously receives multiple driving signals which are the same as those received by the pixel circuits of the display panel and outputs a first output voltage accordingly. The second sensor 205 receives the driving signals at a regular time point after start-up and outputs a second output voltage accordingly. That is, each time after the display panel is started up, the two sensors receive a gate driving signal (Vg) and a drain driving signal (Vd) with different receiving time periods, and the voltages outputted from the two sensors are transmitted to a comparator 209 of the gate driving circuit 207 to be compared. The comparator 209 is positioned in the gate driving circuit 207 of the display 200.

When the comparator 209 determines that the voltage difference between the first output voltage and the second output voltage is beyond a variation standard through comparison, the low level of the pixel gate voltage is adjusted, for example reduced from the original −20 V to −23 V. Particularly, the larger the threshold voltage deviation amount in the display panel is, the lower the low level of the gate voltage transmitted by the gate driving circuit 207 is, so as to reduce the Mura phenomenon, increase the lifetime of the product, and expand the application range of the panel. It should be especially noted that the variation standard should be adjusted according to characteristics of components. For example, the variation standard may be adjusted as considering process factors.

Furthermore, the first sensor 203 and the second sensor 205 of the threshold voltage sensing circuit 206 respectively include a thin film transistor 211, a resistor 213 and a capacitor 215. The thin film transistor 211 is the same as that used by the display panel 201. A gate terminal 217 and a drain terminal 219 of the thin film transistor 211 receive driving signals, such as gate driving signals and drain driving signals, or scanning signals and data signals. One terminal of the resistor 213 is connected in series with a source 221 of the thin film transistor 211, and the capacitor 215 is connected in series with the other terminal of the resistor 213.

For such a connection structure, the thin film transistor 211 functions as an inverter. When the drain terminal 219 of the thin film transistor 211 receives DC voltages of a constant value, the relationship between the input voltage received by the gate of the thin film transistor 211 and the current generated thereby is shown in FIG. 1. When the threshold is shifted towards a negative value after being influenced by a high temperature or driven for a long period of time, the value of the current on the thin film transistor 211 varies even if the input voltages are still the same. Generally, the more the negative shift of the threshold voltage is, the larger the current volume generated under the same input voltage is. Therefore, such a characteristic can be used to observe the shift amount of the threshold voltage.

Figure 3:
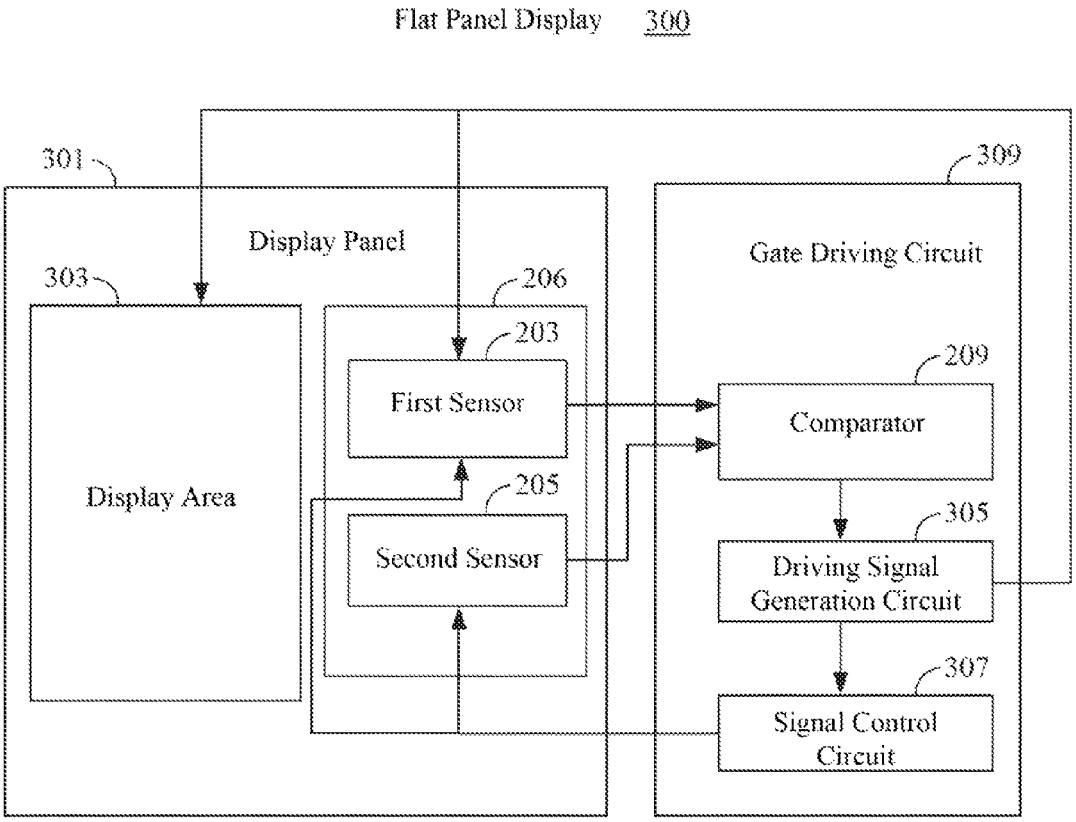
FIG. 3 illustrates a block diagram of a flat panel display according to another embodiment of the invention.

FIG. 3 illustrates a block diagram of a flat panel display according to another embodiment of the invention. A flat panel display 300 used for displaying images includes a display panel 301 and a gate driving circuit 309. The display panel 301 includes multiple pixel circuits. These pixel circuits are arranged in a display area 303. Each pixel circuit includes a pixel thin film transistor (not shown) which receives multiple driving signals.

The display panel 301 further includes the threshold voltage sensing circuit 206. The structure and operation of the threshold voltage sensing circuit 206 is the same as those described in the embodiments of FIGS. 2A and 2B. A detailed operation mode of the threshold voltage sensing circuit 206 can be understood with reference to the embodiments of FIGS. 2A and 2B. The gate driving circuit 309 includes the comparator 209, a driving signal generation circuit 305 and a signal control circuit 307.

The comparator 209 compares the first output voltage and the second output voltage outputted by the first sensor 203 and the second sensor 205. The driving signal generation circuit 305 is used for generating driving signals to drive the display panel 301, such as the gate driving signals and the drain driving signals. The signal control circuit 307 is used for transmitting the driving signals to the first sensor 203 and the second sensor 205 at a regular time point after start-up.

Particularly, when the comparator 209 determines that the voltage difference between the first output voltage and the second output voltage is beyond a variation standard through comparison, the comparator 209 outputs a control signal to the driving signal generation circuit 305, so as to urge the driving signal generation circuit 305 to adjust the low level of the pixel gate voltage (for example, reducing the voltage from −20 V to −23 V). Accordingly, the thin film transistor can be turned off gradually to reduce the influence caused by the threshold voltage deviation and the Mura phenomenon.

Figure 4:
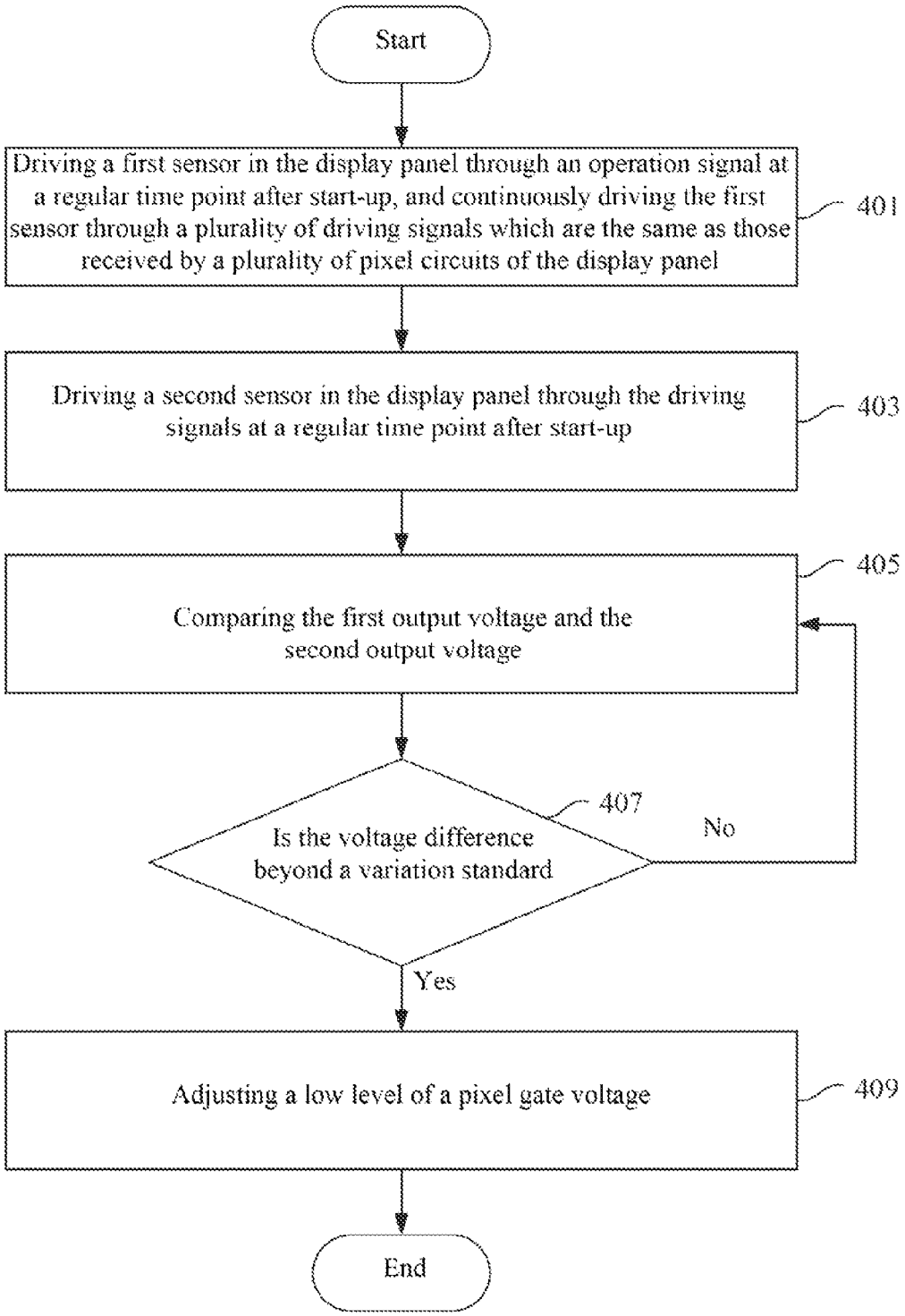
FIG. 4 illustrates a flow chart of a method for sensing a threshold voltage according to a further embodiment of the invention.

FIG. 4 illustrates a flow chart of a method for sensing the threshold voltage according to a further embodiment of the invention. The method for sensing the threshold voltage is applied to the display panel. The method for sensing the threshold voltage includes first driving the first sensor in the display panel through an operation signal at a regular time point after start-up and continuously driving the first sensor through multiple driving signals which are the same as those received by the pixel circuits of the display panel, and outputting a first output voltage through the first sensor accordingly (step 401). Meanwhile, the method drives the second sensor in the display panel through the driving signals at a regular time point after start-up (step 403), in which the second sensor can be driven through the driving signals every five minutes after start-up, for example, so that the second sensor outputs a second output voltage, and the driving signals received by the first sensor and the second sensor are the same as those received by the pixel circuits of the display panel.

After the step 403, the first output voltage and the second output voltage are subsequently compared (step 405); when the voltage difference between the first output voltage and the second output voltage is beyond a variation standard, the low level of a pixel gate voltage is adjusted (step 409). For example, if the voltage difference between the first output voltage and the second output voltage is beyond 1 V, the low level of the pixel gate voltage should be reduced to compensate the influence caused by the threshold voltage shift.

The threshold voltage sensing circuit, the method for sensing the threshold voltage, and the flat panel display of the above-mentioned embodiments can detect the state of the thin film transistor in the display panel in order to determine whether the threshold voltage of the thin film transistor is shifted and to timely adjust the low level of the gate voltage, reduce the Mura phenomenon and increase the lifetime of the display panel.

Although the invention has been disclosed with reference to the above embodiments, these embodiments are not intended to limit the invention. It will be apparent to those of skills in the art that various modifications and variations can be made without departing from the spirit and scope of the invention. Therefore, the scope of the invention shall be defined by the appended claims.

What is claimed is:

1. A threshold voltage sensing circuit applied in a display panel, comprising:

a first sensor positioned in the display panel, the first sensor receiving an operation signal at a regular time point after start-up and continuously receiving a plurality of driving signals which are the same as those received by a pixel circuit of the display panel, and outputting a first output voltage accordingly;

a second sensor positioned in the display panel, the second sensor receiving the driving signals after start-up and outputting a second output voltage accordingly, wherein when the voltage difference between the first output voltage and the second output voltage is beyond a variation standard, a low level of a gate voltage of the pixel circuit is adjusted, and the first sensor receives the driving signals using a first time period, the second sensor receives the driving signals using a second time period, and the first time period and the second time period are different.

2. The threshold voltage sensing circuit of claim 1, wherein the first sensor and the second sensor respectively comprise:

a thin film transistor which is the same as a pixel circuit transistor of the display panel, wherein a gate terminal and a drain terminal of the thin film transistor receive these driving signals;

a resistor having one terminal connected in series with a source of the thin film transistor; and a capacitor connected in series with the other terminal of the resistor.

3. The threshold voltage sensing circuit of claim 1, wherein the first sensor and the second sensor are arranged outside a display area of the display panel.

4. The threshold voltage sensing circuit of claim 1, wherein the driving signals comprise a gate driving signal and a drain driving signal.

5. The threshold voltage sensing circuit of claim 1, wherein the operation signal received by the first sensor at the regular time point after start-up has a constant value.

6. A flat panel display for displaying an image, comprising:

a display panel, comprising:

a plurality of pixel circuits, each of the pixel circuits comprises a pixel thin film transistor, wherein the pixel thin film transistor receives a plurality of driving signals; and a threshold voltage sensing circuit, comprising:

a first sensor positioned in the display panel, the first sensor receiving an operation signal at a regular time point after start-up and continuously receiving a plurality of driving signals which are the same as those received by the pixel circuits of the display panel, and outputting a first output voltage accordingly; and a second sensor positioned in the display panel, the second sensor receiving the driving signals after start-up and outputting a second output voltage accordingly; and a gate driving circuit for driving the display panel, comprising:

a comparator capable of comparing the first output voltage and the second output voltage, wherein when the voltage difference between the first output voltage and the second output voltage is beyond a variation standard, the comparator outputs a control signal to adjust a low level of a pixel gate voltage, and the first sensor receives the driving signals using a first time period, the second sensor receives the driving signals using a second time period, and the first time period and the second time period are different.

7. The flat panel display of claim 6, wherein the gate driving circuit further comprises:

a signal control circuit for transmitting the driving signals to the second sensor using the second time period after start-up.

8. The flat panel display of claim 6, wherein the first sensor and the second sensor respectively comprise:

a thin film transistor which is the same as the pixel circuit transistor of the display panel, wherein a gate terminal and a drain terminal of the thin film transistor receive the driving signals;

a resistor having one terminal connected in series with a source of the thin film transistor; and a capacitor connected in series with the other terminal of the resistor.

9. The flat panel display of claim 6, wherein the first sensor and the second sensor are arranged outside a display area of the display panel.

10. The flat panel display of claim 6, wherein the comparator is positioned in a gate driving circuit of a display.

11. The flat panel display of claim 6, wherein the driving signals comprise a gate driving signal and a drain driving signal.

12. The flat panel display of claim 6, wherein the operation signal received by the first sensor at the regular time point after start-up has a constant value.

13. A method for sensing a threshold voltage, applied in a display panel for sensing a threshold voltage shift, wherein the threshold voltage sensing method comprises:

driving a first sensor in the display panel through an operation signal at a regular time point after start-up, and continuously driving the first sensor through a plurality of driving signals which are the same as those received by a plurality of pixel circuits of the display panel, so as to enable the first sensor to output a first output voltage;

driving a second sensor in the display panel through the driving signals after start-up, so as to enable the second sensor to output a second output voltage;

comparing the first output voltage and the second output voltage; and adjusting a low level of a pixel gate voltage when the voltage difference between the first output voltage and the second output voltage is beyond a variation standard, wherein the first sensor receives the driving signals using a first time period, the second sensor receives the driving signals using a second time period, and the first time period and the second time period are different.

14. The method of claim 13, wherein the operation signal received by the first sensor at the regular time point after start-up has a constant value.

* * * * *